US009708157B2

(12) United States Patent
Della Porta et al.

(10) Patent No.: US 9,708,157 B2
(45) Date of Patent: Jul. 18, 2017

(54) CONTROLLING SPEED OF AN ELEVATOR USING A SPEED REDUCING SWITCH AND GOVERNOR

(75) Inventors: Joseph L. Della Porta, Southington, CT (US); Barry G. Blackaby, Granby, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 418 days.

(21) Appl. No.: 14/372,412

(22) PCT Filed: Feb. 3, 2012

(86) PCT No.: PCT/US2012/023747

§ 371 (c)(1),
(2), (4) Date: Jul. 15, 2014

(87) PCT Pub. No.: WO2013/115827

PCT Pub. Date: Aug. 8, 2013

(65) Prior Publication Data

US 2014/0367206 A1 Dec. 18, 2014

(51) Int. Cl.

| | |
|---|---|
| ***B66B 1/34*** | (2006.01) |
| ***B66B 1/32*** | (2006.01) |
| ***B66B 5/06*** | (2006.01) |
| ***B66B 1/30*** | (2006.01) |
| ***B66B 5/00*** | (2006.01) |
| ***B66B 5/04*** | (2006.01) |

(52) U.S. Cl.

CPC ..... *B66B 1/32* (2013.01); *B66B 1/30* (2013.01); *B66B 5/0031* (2013.01); *B66B 5/044* (2013.01); *B66B 5/06* (2013.01)

(58) Field of Classification Search

CPC B66B 1/32; B66B 1/30; B66B 5/0031; B66B 5/044; B66B 5/06

USPC ..... 187/247, 288, 293, 296, 297, 391, 393

See application file for complete search history.

(56) References Cited

U.S. PATENT DOCUMENTS

| | | | | |
|---|---|---|---|---|
| 5,052,523 | A | 10/1991 | Ericson | |
| 5,377,786 | A | 1/1995 | Nakagawa | |
| 6,170,614 | B1 * | 1/2001 | Herkel | B66B 1/32 187/287 |

(Continued)

FOREIGN PATENT DOCUMENTS

| | | |
|---|---|---|
| CN | 1663902 A | 9/2005 |
| EP | 1880967 A1 | 1/2008 |

(Continued)

OTHER PUBLICATIONS

Chinese Office Action, Application No. 201280068876.9 dated on Feb. 3, 2012.

*Primary Examiner* — Anthony Salata
(74) *Attorney, Agent, or Firm* — Cantor Colburn LLP

(57) ABSTRACT

A system and method for controlling speed of an elevator car in an elevator system is disclosed. The elevator car may have a speed governor adapted to trip when an electrical tripping point of the speed governor is reached. The elevator system may also have a control system for controlling operation of the elevator car, the control system providing a speed reducing switch adapted to trip when a software tripping point of the speed reducing switch is reached, the software tripping point being reached before the electrical tripping point of the speed governor.

17 Claims, 2 Drawing Sheets

(56) References Cited

U.S. PATENT DOCUMENTS

| | | | | |
|---|---|---|---|---|
| 6,227,334 | B1 | 5/2001 | Yumura et al. | |
| 7,137,484 | B2 | 11/2006 | Martin | |
| 7,228,943 | B2 | 6/2007 | Kugiya et al. | |
| 7,353,916 | B2 * | 4/2008 | Angst | B66B 5/0031 187/314 |
| 7,448,472 | B2 * | 11/2008 | Kugiya | B66B 5/06 187/287 |
| 7,533,763 | B2 * | 5/2009 | Kattainen | B66B 1/28 187/287 |
| 7,597,176 | B2 | 10/2009 | Zaharia | |
| 7,918,320 | B2 * | 4/2011 | Kondo | B66B 5/0031 187/288 |
| 8,177,034 | B2 * | 5/2012 | Ueda | B66B 5/0062 187/293 |
| 8,235,180 | B2 * | 8/2012 | Kattainen | B66B 5/06 187/288 |
| 8,752,677 | B2 * | 6/2014 | Harkonen | B66B 1/34 187/288 |
| 8,939,262 | B2 * | 1/2015 | Schienda | B66B 5/06 187/287 |
| 2010/0025646 | A1 | 2/2010 | Dube | |

FOREIGN PATENT DOCUMENTS

| | | | |
|---|---|---|---|
| EP | 2380841 | A1 | 10/2011 |
| WO | 2009078844 | A1 | 6/2009 |

* cited by examiner

CONTROLLING SPEED OF AN ELEVATOR USING A SPEED REDUCING SWITCH AND GOVERNOR

CROSS-REFERENCE TO RELATED APPLICATIONS

This application is a U.S. national stage filing under 35 USC §371 of International Patent Application No PCT/US11/23747 filed on Feb. 3, 2012.

FIELD OF THE DISCLOSURE

The present disclosure generally relates to elevator systems and, more particularly, relates to systems and methods for reducing speeds of an elevator car in an elevator system.

BACKGROUND OF THE DISCLOSURE

Elevator systems are widely used for transporting people or goods from one point to another. An elevator system typically includes an elevator car connected to a counterweight by way of hoisting ropes, such as, steel cables and adapted to move vertically in an elevator hoistway or elevator shaft. These hoisting ropes extend over a sheave or machine located in a machine room above the elevator car. A motor connected to the machine provides power to move the elevator car between two positions. The machine (and specifically the motor of the machine) is provided with a brake system of one or more brakes to stop the elevator car as desired and to prevent undesired motion of the elevator car.

In addition to the brake system, most elevator systems are equipped with safety systems for initiating an emergency stop of the elevator car in case of any over speed situations of the elevator car. One such emergency safety feature is a speed governor, which typically includes a governor rope passing over the speed governor pulley and extending downward to a tensioning pulley located at the bottom of the elevator shaft. The speed governor is adapted to detect an over speed situation of the elevator car based upon a ratio of the rotational velocity of the governor pulley proportional to the speed of the elevator car. The governor pulley is connected to a centrifugally operated trip device, which engages a mechanical device that will activate the safeties of the elevator car when the elevator car reaches a predetermined over speed condition.

The speed governor may either be located within the machine room, hoistway or, on top of the elevator car. In operation, as the elevator car travels up and down the elevator shaft, flyweights provided on the governor pulley move outwardly due to the centrifugal force imparted thereon by the rotating governor pulley. When the speed of the elevator car exceeds a rated speed by a predetermined value, the flyweights are driven outwardly and are caused to trip an over speed switch which cuts off (or substantially reduces) power to the drive motor and simultaneously sets the brake. In the event the elevator car speed continues to increase, the further outward motion of the flyweights cause the flyweights to contact and activate a mechanical device, and engage safeties 5 provided on the elevator car to arrest motion of the elevator car.

As the normal rated speeds of modern elevator systems have continued to rise, so has the need to have more robust and reliable safety systems in elevator cars. Safety code requirements for elevators and escalators require that for elevator systems operating at certain speeds, such as, at or over two hundred feet per minute (200 FPM or 1.016 meters/second) and having a speed governor with an over speed switch that operates at the same over speed tripping point of the mechanical device of the speed governor, a speed reducing switch be employed for reducing speed of an elevator car in over speed conditions of the elevator car in addition to the over speed switch of the speed governor. These code requirements further require that the speed reducing switch be of a manually reset type such that after tripping (e.g., activating) the speed reducing switch, the elevator car remains in an inoperative state until the switch is manually reset. The code additionally states that when the speed reducing switch is provided, its speed trip point be about ten percent (10%) below the speed governor over speed switch.

Accordingly, it would be beneficial if an electronic speed reducing switch in compliance with the code requirements were developed.

SUMMARY OF THE DISCLOSURE

In accordance with one aspect of the present disclosure, an elevator system is disclosed. The elevator system may include an elevator car and a speed governor adapted to trip when an over speed tripping point of the speed governor is reached. The elevator system may also include a control system for controlling operation of the elevator car, the control system providing an electronic speed reducing switch adapted to trip when a software tripping point of the speed reducing switch is reached, the software tripping point being reached before the over speed tripping point of the speed governor.

In accordance with another aspect of the present disclosure, a method for providing a speed reducing switch functionality for an elevator car in an elevator system is disclosed. The method may include providing an elevator car and a speed governor adapted to trip when an electrical tripping point of the speed governor is reached and providing a control system for controlling operation of the elevator car, the control system providing a speed reducing switch adapted to trip when a software tripping point of the speed reducing switch is reached, the software tripping point being reached before the electrical tripping point of the speed governor. The method may also include sensing a speed of the elevator car and providing the speed to the control system, determining whether an over speed situation has occurred and determining whether the software tripping point of the speed reducing switch is reached and an over speed situation has occurred. The method may further include arresting motion of the elevator car and setting a slow down latch if the software tripping point of the speed reducing switch was reached.

In accordance with yet another aspect of the present disclosure, an elevator system is disclosed. The elevator system may include an elevator car and a speed governor having an over speed switch for arresting motion of the elevator car in an over speed situation, the over speed switch adapted to trip when an electrical tripping point is reached and a control system for controlling operation of the elevator car. The control system may provide a speed reducing switch having (a) a motion control adapted to arrest motion of the elevator car in the over speed situation when a software tripping point is reached, the software tripping point being reached before the electrical tripping point of the speed governor; (b) a speed sensing device to determine the software tripping point; and (c) a manual reset module for resetting a slow down latch manually when the software tripping point is reached Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the exemplary embodiments illustrated in greater detail on the accompanying drawings, wherein.

While the following detailed description has been given and will be provided with respect to certain specific exemplary embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims eventually appended hereto, and their equivalents.

DETAILED DESCRIPTION OF THE DISCLOSURE

Figure 1:
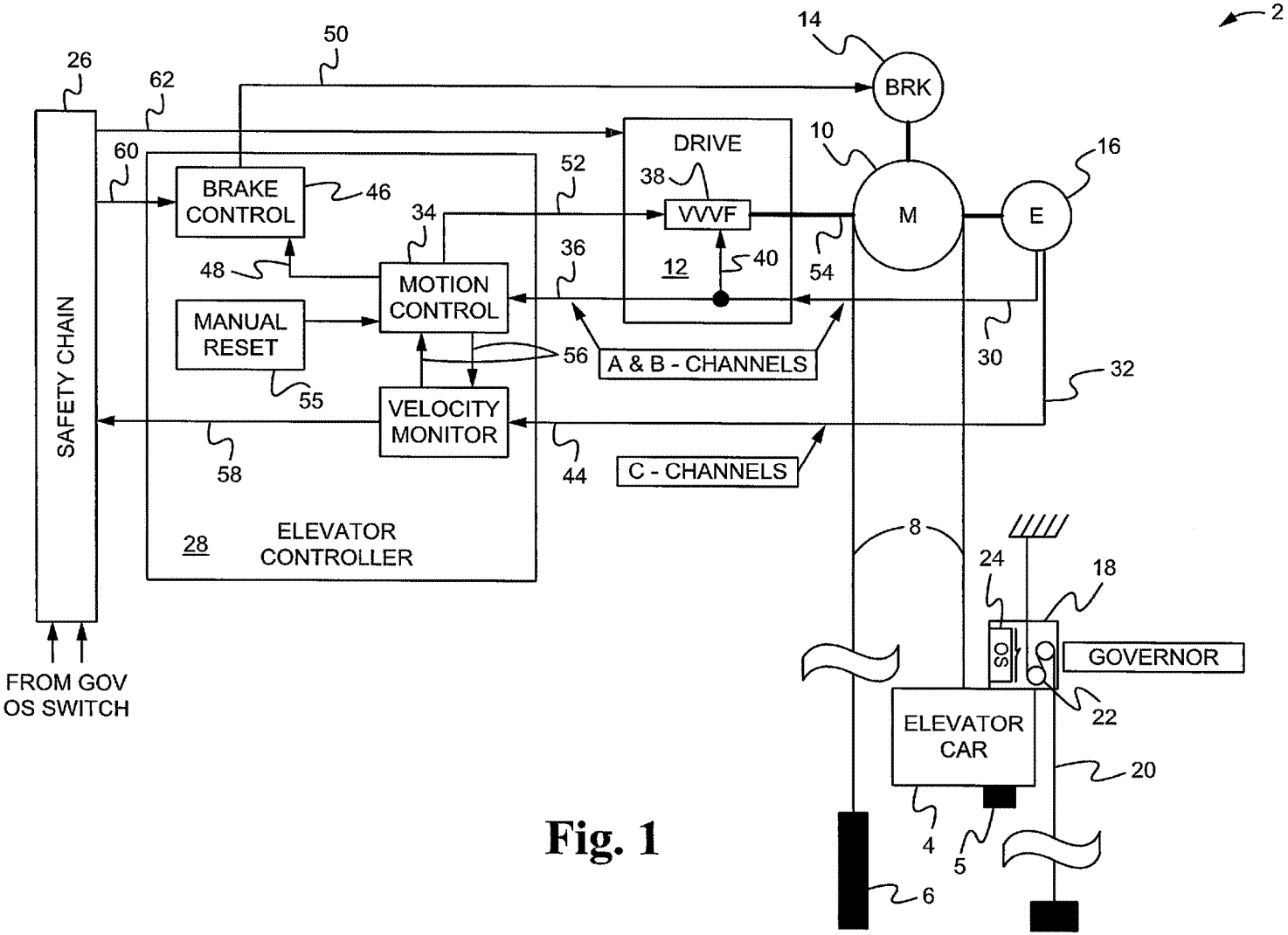
FIG. 1 is a simplified schematic block diagram of an elevator system, in accordance with at least some embodiments of the present disclosure.

Referring now to FIG. 1, a simplified schematic block diagram of an elevator system 2 is shown, in accordance with at least some embodiments of the present disclosure. While all of the components of the elevator system 2 have not been shown and/or described in detail herein, a typical elevator system may include an elevator car 4 connected to a counterweight 6 via hoisting ropes 8. The elevator car may move along guide rails (not shown) positioned within an elevator hoistway or shaft (also not shown). The hoisting ropes 8 may in turn extend over a traction sheave or machine 10, driven by a drive motor within the machine (e.g., the machine may be the rotor of the drive motor) to move or halt the elevator car 4 as desired. Power to the drive motor within the machine 10 may be provided by a drive system 12, which is explained in greater detail below.

In addition to the aforementioned components, the elevator system 2 may also include mechanisms for slowing or halting the elevator car 4 during both, normal operation as well as any emergency situations. For example, the elevator system 2 may include a brake or brake system 14 connected at least indirectly to the machine 10 for slowing or halting the elevator car 4 during normal operation. The brake 14 may also be activated during emergency conditions, as will be described further below. An encoder 16 may be connected at least indirectly to the machine 10 for sensing the speed (e.g., velocity) and direction of travel of the elevator car 4, which data may then be employed for activating the brake 14 in both normal and over speed situations. In addition to the brake 14, the elevator system 2 may include a governor (also referred to herein as a speed governor) 18 for slowing or halting the elevator car 4 in any over speed situations. In at least some embodiments and, as shown, the governor 18 may be mounted on top of the elevator car 4 and may include a governor rope 20 passing over a governor pulley 22. The governor 18 may also be adapted to sense the speed and direction of travel of the elevator car 4. In other embodiments, the governor 18 may be situated within the hoistway or a machine room housing the machine 10.

Generally speaking, if the speed of the elevator car 4 exceeds a rated speed by a predetermined value, then opposing flyweights mounted on the governor pulley 22 may be driven outwardly to trip an over speed switch 24 mounted on the governor 18 to cut power to the drive motor, actuate the brake 14 and/or engage a safety chain 26 or other safeties (not shown) connected to the elevator system 2. In that regard, the governor 18 may provide two tripping points for slowing or halting the elevator car 4, namely, (a) an electrical tripping point in which the governor may trip the over speed switch 24 to activate the safety chain 26 that will disengage the drive system 12 to the machine 10 (in other words, cut power (or at least substantially reduce power) to the drive motor) and engage the brake 14 and (b) a mechanical tripping point in which the safeties (not shown) of the elevator system may be engaged. The construction and operation of the governor 18 is well known in the art and, accordingly, for conciseness of expression, it has not been described here in great detail.

Relatedly, the elevator system 2, with the counterweight 6, operates in a known manner and is therefore, not described in detail here. It will be understood, however, that components other than those described above, such as, an elevator car frame, guide assembly, etc., are contemplated and considered within the scope of the present disclosure.

Referring still to FIG. 1, the operation of the drive system 12 and the brake 14 (and therefore the operation of the machine 10 and the elevator car 4) may be controlled by a controller (or control system) 28. As shown, the controller 28 may receive information from the encoder 16 and may utilize that information to control the drive system 12 and the brake 14. Information from the encoder 16 may also be used to engage the safety chain 26. Furthermore, although in the present embodiment, the encoder 16 has been described as sensing the speed and direction of travel of the elevator car 4, in at least some other embodiments, devices (e.g., speed sensing devices) other than encoders that are capable of sensing the above parameters may be employed as well.

In at least some embodiments in which the encoder 16 is employed, the encoder may be a three (3) channel encoder having A&B channels 30, which may sense the speed and direction of the elevator car 4 and a C channel 32, which may also sense the speed (e.g., velocity) of the elevator car independent from the A&B channels. The C channel 32 specifically may be employed for slowing or halting the elevator car 4 in an emergency situation and for checking for any electrical failures or malfunction within the controller 28. To the extent that the C channel 32 may provide a safety feature for slowing or halting the elevator car 4.

Furthermore, in at least some embodiments and, as described further below, the controller 28 may be adapted to provide a software tripping point, which in at least some embodiments, may be an electrical tripping point similar to that provided by the governor 18. In addition, the software tripping point of the controller 28 may be activated before the tripping point of the governor 18 is activated. With respect to determining the software tripping point of the controller 28, information (speed and direction of travel) about the elevator car 4 from the A&B channels 30 of the encoder 16 may be provided to a motion control system 34 (also referred to herein as motion control) within the controller, as shown by link 36, as well as to a variable voltage variable frequency (VVVF) drive 38 within the drive system 12, as shown by link 40. The motion control 34 may utilize the information (speed, position and direction of travel of the elevator car 4) from the encoder 16 and particularly, from the A&B channels 30, for slowing or halting the elevator car in the event of over speeding.

Similarly, the speed measured by the C channel 32 may be provided to a velocity monitor module 42 situated within the controller 28, as shown by link 44. As will be described further below, the velocity monitor module 42 may utilize the speed provided by the C channel 32 to detect any failures within the motion control 34 and also to arrest motion of the elevator car 4 in the event of any failure within the motion control. Thus, the motion control 34 (either alone or in conjunction with the velocity monitor module 42) may provide a speed reducing functionality. To that extent, the motion control 34 (and/or the velocity monitor module 42) may provide a speed reducing switch that may be employed to arrest motion of the elevator car 4 in the event of any over speed situations. Thus, in addition to using the governor 18 for handling over speed situations in the elevator car 4, at least some embodiments of the present disclosure also provide a mechanism to control the speed of the elevator car via the controller 28.

Specifically, if the speed of the elevator car 4 exceeds a rated speed of the elevator by a predetermined value (e.g., first threshold), then the controller 28 and particularly, the motion control 34 may reach its software tripping point and may instruct the drive system 12 to cut off (or at least substantially reduce) power to the drive motor (and therefore the machine 10) and also instruct the brake 14 to stop the elevator car. However, if the above actions fail to control the speed of the elevator car 4 and if the elevator car continues to over speed, then above a certain speed threshold (e.g., above a second threshold of the rated speed), the governor 18 may reach its electrical and mechanical tripping points and activate the safety chain 26, engage other safeties within the elevator system 2, instruct the drive system 12 to cut off (or substantially reduce) power to the drive motor and engage the brake 14.

More specifically, if the speed of the elevator car 4 as sensed by the encoder 16 is greater than the first threshold, the motion control 34 may reach its software tripping point and may notify and activate a brake control module 46 via a link 48 situated within the controller 28. The brake control module 46 may in turn activate (e.g., drop) the brake 14 via link 50, which in turn may slow or halt the elevator car 4. The brake control module 46, as well as the operation of the brake 14 for slowing or halting the elevator car 4 is well known in the art and, therefore, has not been described here. In addition to activating the brake control module 46, the motion control 34 may also communicate with the VVVF drive 38 via link 52 to control (e.g., cut or substantially reduce) power to the drive motor of the machine 10 via link 54. Thus, upon receiving a signal (via the link 52) from the motion control 34 to stop or reduce the speed of the elevator car 4, the VVVF drive 38 may take the information provided by the A&B channels 30 of the encoder 16 to modify the torque and frequency of operation of the drive motor to reduce the speed thereof (via the link 54) in order to bring the speed of the elevator car within safe limits of the rated speed.

Furthermore, if the motion control 34 reaches its software tripping point and if the brake 14 and the VVVF drive 38 are activated by the motion control to arrest the over speed motion of the elevator car 4, then a latch (e.g., a slow down latch implemented in software form) within a manual reset module 55 may also be set. Once the latch is set, it may need to be reset manually after the over speed condition of the elevator car 4 is under control and before the elevator car can resume normal operation, as specified by the safety code for elevators and escalators. Manual reset may include reset by a finger or hand of a user or operator, a cable actuated lever, cam or other electromechanical actuation from the location of the controller 28 outside of the elevator hoistway. Once the latch within the manual reset module 55 has been reset, the elevator car 4 may resume normal operation.

Additionally, in order to check for any failures or malfunction within the motion control 34 and to provide a reliable and robust emergency safety system, the velocity monitor module 42 may be employed. As mentioned above, the velocity monitor module 42 may receive the speed of the elevator car 4 as measured independently (from the A&B channels 30) by the C channel 32 of the encoder 16. The velocity monitor module 42 may utilize that speed and cross-check the speed with the speed received by the motion control 34 via the A&B channels 30. The speed cross-check between the motion control 34 and the velocity monitor module 42 is shown by cross-check links 56. By virtue of cross-checking the speeds between the velocity monitor module 42 and the motion control 34, any malfunction or failure within the motion control may be detected. For example, if the speeds between the two modules is different beyond a certain threshold indicating a malfunction or failure within the motion control 34, and if the speed of the elevator car 4 is determined (by the velocity monitor module 42) to be above a predetermined value over the rated speed, then the velocity monitor module may initiate an emergency situation and activate the safety chain 26, as indicated by link 58. The safety chain 26, in at least some embodiments, may be a series of electronic protective devices (EPD) connected together, such that if any one of the EPDs is not closed (e.g., if any one is deactivated), then the elevator car 4 may be prohibited from moving. The safety chain 26, upon being invoked, may also be capable of activating the brake control module 46 for activating the brake 14, as shown by link 60 and communicating with the drive system 12 (e.g., the VVVF drive 38) to control the speed of the elevator car 4 via link 62.

Notwithstanding the fact that in the present embodiment, the encoder 16 and particularly, the A&B channels 30 and the C channel 32 have been utilized for providing the speed reducing switch functionality in the elevator car 4, in at least some embodiments, other mechanisms may be employed. For example, instead of using separate channels, a single one of the channels, or alternatively, more than three (A&B, C) channels may be used. Mechanisms other than the velocity monitor module 42 to determine any failures within the motion control 34 may be utilized as well.

Figure 2:
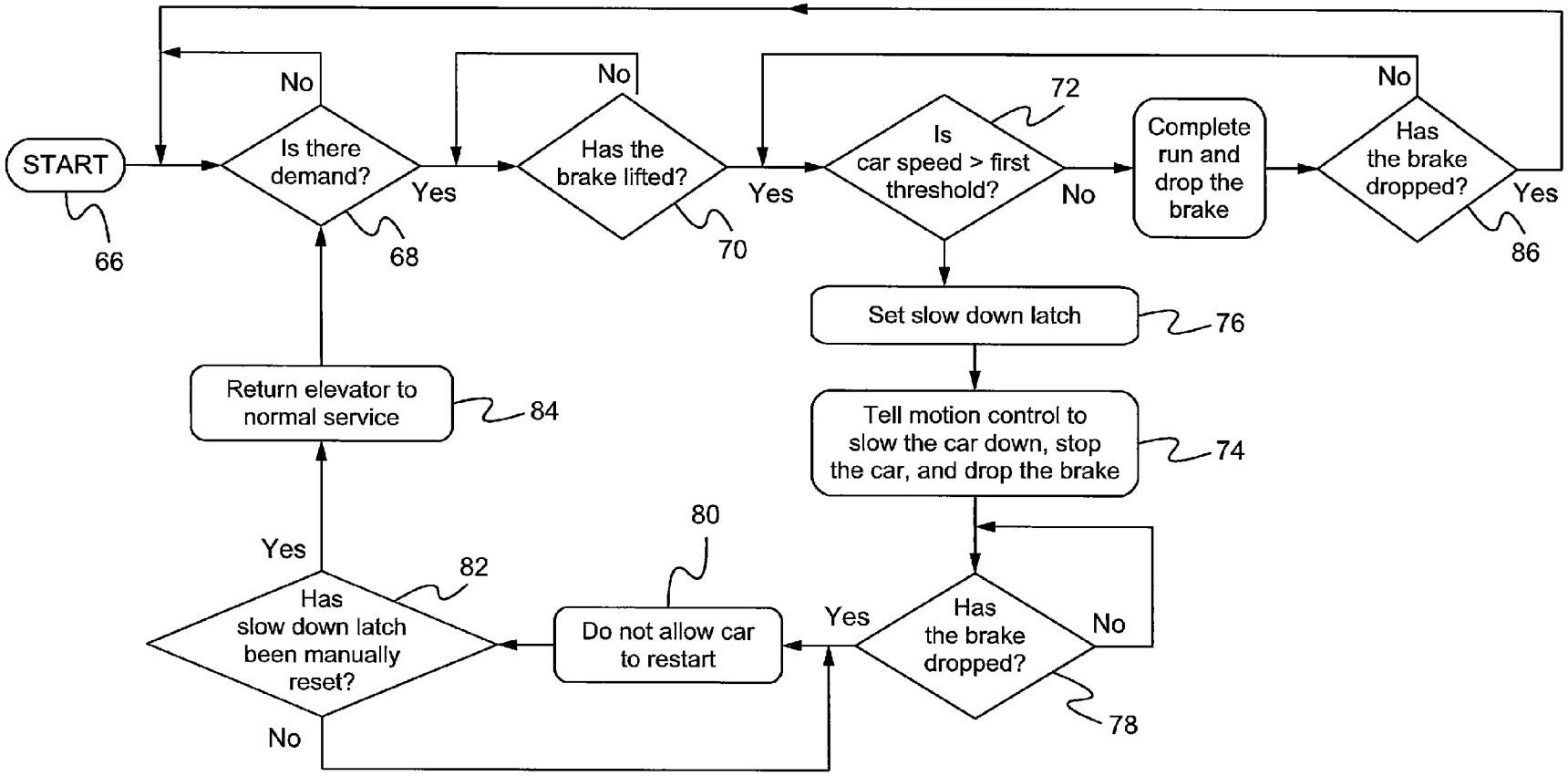
FIG. 2 is an exemplary flowchart outlining steps for reducing speed of an elevator within the elevator system of FIG. 1.

Referring now to FIG. 2, an exemplary flowchart 64 outlining steps that may be performed by the motion control 34 in providing a speed reducing switch functionality to reduce speed of the elevator car 4 in over speed situations is shown, in accordance with at least some embodiments of the present disclosure. As shown, after starting at a step 66, the process proceeds to a step 68, where it may be determined whether a demand for moving the elevator car 4 exists. A demand for moving the elevator car 4 may exist or be made when one or more users (or goods) may need to ride the elevator car 4 for getting from one point to another. If a demand for moving the elevator car 4 exists, then at a step 70, it may be determined whether the brake 14 has been activated (e.g., lifted) or not. On the other hand, if at the step 68, no demand for moving the elevator car 4 exists, then the process may continue to remain at the step 68 until a demand for moving the elevator car 4 is made.

Now, at the step 70, if the brake 14 is OFF (e.g., if the brake is lifted or deactivated), then a speed of the elevator car 4 may be determined at a step 72. If the brake 14 at the step 70 is ON (e.g., has dropped or activated), then the process may stay at the step 70 until the brake has been lifted. The brake 14 may be ON at the step 70 for several reasons. For example, the brake 14 may be ON during a normal operation of the elevator car 4 after reaching the requested destination. The brake 14 may also be ON if an over speed event in the elevator car 4 has been detected from a previous operation of the elevator car and the software tripping point of the controller 28 and/or the electrical/mechanical tripping points of the governor 18 have reached, which may have activated the brake. The brake 14 may also be activated manually during regular maintenance of the elevator system 2. Thus, if the brake is ON for any of the above cited reasons or for any other reason, the process may stay at the step 70 until the brake has lifted or tuned OFF. It will also be understood that if the brakes are activated due to an over speed event, a manual resetting of the latch within the manual reset module 55 may be required before the elevator car 4 may resume operation.

Upon lifting the brake 14, the speed of the elevator car 4 may be determined at the step 72. Specifically and, as mentioned above, the speed of the elevator car 4 may be measured by several components provided within the elevator system 2. For example, the speed of the elevator car 4 may be measured by the encoder 16 and, particularly, by the A&B channels 30 of the encoder. The speed of the elevator car 4 may also be measured independently by the C channel 32 of the encoder 16. In addition, the governor 18 may sense and measure the speed of the elevator car 4. After measuring the speed of the elevator car 4, it may be determined whether the elevator car is operating within its normal rated speed limit or whether the elevator car is over speeding. The value of the rated speed may vary in different elevator systems. For example, the rated speed of an elevator system may depend upon the capacity of the elevator car 4 and also the highest distance that the elevator car may be designed to travel. In at least some embodiments, the elevator car 4 may have a rated speed of about two hundred feet per minute (200 FPM or 1.016 meters per second) and in at least some of those embodiments, any speed of the elevator car 4 above the rated speed of, for example, two hundred feet per minute (200 FPM or 1.016 meters per second) may be deemed abnormal and may be termed as an over speed event of the elevator car. In other embodiments, the rated speed and the abnormal speed of the elevator car 4 to invoke an over speed event may vary. If the over speed value of the elevator car 4 is beyond a predetermined limit of the rated speed, then the elevator car may need to be slowed down or completely stopped in an emergency condition.

For example, in at least some embodiments, if the over speed value of the elevator car 4 is greater than five percent 5% of the rated speed, i.e., 5% greater than two hundred and ten feet per minute (210 FPM or 1.067 meters per second), then the software tripping point of the controller 28 may be reached and the elevator car may need to be slowed and/or stopped, as outlined by steps 74-84. On the other hand, if the over speed value of the elevator car 4 is greater than rated speed but less than first threshold, then the speed of the elevator car may continue to be monitored and the elevator car may continue normal operation (but an electrical tripping point may not reached), and the process may proceed to a step 86.

With respect to the steps 74-84, which provide over speed protection (by reaching the software tripping point of the controller 28) to the elevator car 4 in the event of an over speed greater than the first threshold the motion control 34 at the step 74 may notify the brake control module 46 via the link 48 of the over speed event of the elevator car 4 and request the brake control module to activate the brake 14. In addition, the motion control 34 may also communicate with the drive system 12 to control the VVVF drive 38 via the link 52 to control power to the drive motor of the machine 10 for slowing and/or halting the motion of the elevator car. Next, at the step 76, the latch (also referred to herein as the slow down latch) within the manual reset module 55 may also be set by the motion control 34. The latch may be set automatically, as soon as the software tripping point of the controller 28 is reached or it may be set by the motion control 34. Again, once the latch has been set, either by the motion control 34 or automatically, the elevator car 4 may not resume normal operation until the latch has been reset manually in a manner described above.

After communicating with the brake control module 46 and the VVVF drive 38 to engage the brake 14 and reduce or remove power to the drive motor, respectively, the motion control 34 may continuously monitor both the brake control module and the VVVF drive to determine whether the brake has dropped (e.g., turned ON or activated) or not and whether the elevator car 4 has stopped moving or not at the step 78. If at the step 78, the brake 14 is not activated and the elevator car 4 continues to move after actuating the brake control module 46 and the VVVF drive 38, the motion control 34 may continue to monitor the speed of the elevator car 4 and may also continue to observe the brake 14 at the step 78. If the speed of the elevator car 4 increases further beyond the second threshold, the speed governor 18 may kick in to trip the over speed switch 24 (for actuating the brake 14 and reducing/cutting power to the drive motor) and engage the safety chain 26 and other safeties 5 of the elevator system. It will be understood that the governor 18 may reach its electrical and mechanical tripping points simultaneously at the same time. The tripping points of the governor 18 may also set the latch of the step 76, which may then require a manual reset. The velocity monitor module 42 may also kick in to arrest motion of the elevator car 4 if a failure is detected within the motion control 34 and if the motion control fails to stop (or slow) the elevator car. In at least some embodiments, arresting motion of the elevator car 4 by the velocity monitor module 42 may be actuated before the electrical/mechanical tripping points of the governor 18.

If at the step 78, the brake 14 drops (e.g., turns ON), either by the controller 28 and/or the governor 18, then at the step 80, the elevator car 4 stops and may not be permitted to resume operation until the latch has been reset manually, as outlined by the steps 80 and 82. The latch may be manually reset at the step 82. Upon resetting the latch at the step 82, the elevator car 4 may resume normal operation at the step 84 and proceed to the step 68 and wait for a demand to move the elevator car.

Going back to the step 72, if the elevator car 4 is operating within its rated speed value or is over speed by less than first threshold, then at the step 86, it may be determined whether the brake 14 has dropped (e.g., turned ON). The brake 14 at this point may drop due to a normal operation request to stop the elevator car 4. If the brake 14 drops, then the process loops back to the step 68 and waits for a new demand to move the elevator car 4. If the brake 14 does not drop at the step 86, and the elevator is still moving, the encoder 16 continues to sense the speed the elevator car and the motion control 34 continues to monitor the speed of the elevator car at the step 72 for any over speed conditions. It will again be understood that while the present disclosure has been described with a rated speed of about two hundred feet per minute (200 FPM) and specific over speed values, all of these speed values (including the rated speed) are merely exemplary and may vary in other embodiments, as described above.

INDUSTRIAL APPLICABILITY

In general, the present disclosure sets forth an elevator system having an elevator car with a car mounted governor. The governor may be provided with an over speed switch for reducing and/or stopping the elevator car in events of over speeds. The governor may be adapted to have an electrical tripping point in which the governor may activate a brake system and may also reduce or cut power to a drive motor driving the elevator car. The governor may also have a mechanical tripping point in which various safeties and safety chain of the elevator system may be activated to arrest motion of the elevator car. In at least some embodiments, the governor electrical and mechanical tripping points may be reached simultaneously. A speed limiting function (by way of a speed reducing switch) may also be provided by a controller of the elevator system in which an encoder (or other speed sensing device) may sense the speed of the elevator car and may convey that speed to an motion control within the controller. The motion control may reach its software tripping point if the elevator car speeds over a predetermined value of its rated speed and then the may activate the brake system and reduce/cut power to the drive motor.

The software tripping point of the controller may be reached before the electrical and mechanical tripping points of the governor. Specifically, the governor may kick in if the motion control fails to slow/halt the elevator car in over speed conditions. In at least some embodiments, the motion control may reach its tripping point at about the first set point over the rated speed and the governor may reach its tripping point at about the second set point over the rated speed. It will be understood that these tripping point values and rated speed values are merely exemplary and may vary depending upon the particular elevator system under consideration.

By virtue of providing the speed reducing functionality by utilizing the speed reducing switch of the controller, the speed reducing switch that was conventionally provided on the governor is not needed. Further, the elevator system of the present disclosure conforms to the safety code requirements as set forth above for providing a speed reducing functionality in addition to the over speed switch functionality of speed governors in elevators that are operated at speeds of, for example, two hundred feet per minute or greater. A manual reset function as required by the code is also provided. Furthermore, the present mechanism utilizes the same hardware that is commonly used in elevator systems, while only modifying the software of the controller. Moreover, the velocity monitor functionality provides a way to monitor the over speed condition of the elevator car throughout the hoistway and not just at the terminal landings and also provides a reliable and robust mechanism for checking for electrical failures within the controller.

While only certain embodiments have been set forth, alternatives and modifications will be apparent from the above description to those skilled in the art. These and other alternatives are considered equivalents and within the spirit and scope of this disclosure and the appended claims.

What is claimed is:

1. An elevator system, comprising:

an elevator car;

a speed governor adapted to trip when a speed of the elevator car reaches a second speed corresponding to an electrical tripping point; and a control system for controlling operation of the elevator car the control system providing a speed reducing switch adapted to trip when the speed of the elevator car reaches a first speed corresponding to a software tripping point of the speed reducing switch, the first speed being lower than the second speed.

2. The elevator system of claim 1, wherein the speed governor is further adapted to trip when the speed of the elevator car reaches a third speed corresponding to a mechanical tripping point of the speed governor.

3. The elevator system of claim 2, wherein the second speed and the third speed are equal.

4. The elevator system of claim 2, wherein the electrical tripping point cause at least one of (a) a brake of the elevator system to be activated; and (b) at least significantly reduces power to a drive motor that operates the elevator car.

5. The elevator system of claim 2, wherein the mechanical tripping point causes the car mounted safeties of the elevator system to be engaged.

6. The elevator system of claim 1, wherein the software tripping point of the control system causes at least one of (a) a brake of the elevator system to be activated; and (b) at least significantly reduces power to a drive motor that operates the elevator car.

7. The elevator system of claim 1, further comprising a speed sensing device sensing the speed of the elevator car.

8. The elevator system of claim 7, wherein the speed sensing device is an encoder comprising A&B channels for providing the speed of the elevator car to a motion control sub system of the control system, the encoder further comprising a C channel for independently sensing the speed of the elevator car from the A&B channels.

9. The elevator system of claim 7, wherein the speed sensing device is adapted to determine failures within the control system.

10. The elevator system of claim 1, wherein when the elevator car reaches the first speed, the control system sets a slow down latch separate from the speed reducing switch.

11. The elevator system of claim 10, wherein the elevator car cannot resume operation unless the slow down latch is reset manually.

12. A method for providing a speed reducing switch functionality for an elevator car in an elevator system, the method comprising:

providing an elevator car and a speed governor adapted to trip when a speed of the elevator car reaches a second speed corresponding to an electrical tripping point;

providing a control system for controlling operation of the elevator car, the control system providing a speed reducing switch adapted to trip when the speed of the elevator car reaches a first speed corresponding to a software tripping point of the speed reducing switch, the first speed being lower than the second speed;

sensing the speed of the elevator car and providing the speed to the control system;

in response to the speed of the elevator car reaching the first speed, setting a slow down latch separate from the speed reducing switch and applying a brake to stop motion of the elevator car.

13. The method of claim 12, wherein the speed of the elevator car is sensed by a speed sensing device, the speed being utilized to determine failures within the control system.

14. The method of claim 12, further comprising tripping an over speed switch of the speed governor if the software tripping point of the control system does not arrest motion of the elevator car and the speed of the elevator car continues to increase.

15. The method of claim 12, further comprising resetting the slow down latch manually to resume operation of the elevator car if the software tripping point has reached.

16. An elevator system, comprising;

an elevator car;

a speed governor having an over speed switch for arresting motion of the elevator car in an over speed situation, the over speed switch adapted to trip when a speed of the elevator car reaches a second speed corresponding to an electrical tripping point; and a control system for controlling operation of the elevator car, the control system providing a speed reducing switch having (a) a motion control adapted to arrest motion of the elevator car in the over speed situation when the speed of the elevator car reaches a first speed corresponding to a software tripping point, the first speed being lower than the second speed; (b) a speed sensing device to determine the software tripping point; and (c) a manual reset module for resetting a slow down latch manually when the software tripping point is reached.

17. The elevator system of claim 16, further comprising an encoder having at least one channel configured to sense the speed of the elevator car and providing a sensed speed to the motion control, the encoder, further having an independent channel for sensing the speed of the elevator car and providing the speed to a velocity monitor module.

* * * * *